US006822627B2

(12) United States Patent
Uemura et al.

(10) Patent No.: US 6,822,627 B2
(45) Date of Patent: Nov. 23, 2004

(54) PLASMA DISPLAY PANEL AND IMAGING DEVICE USING THE SAME

(75) Inventors: Norihiro Uemura, Higashimorokata (JP); Keizo Suzuki, Kodaira (JP); Hiroshi Kajiyama, Fuchu (JP); Yusuke Yajima, Kodaira (JP); Masayuki Shibata, Miyazaki (JP); Yoshimi Kawanami, Miyazaki (JP); Koji Ohira, Miyazaki (JP); Ikuo Ozaki, Higashimorokata (JP)

(73) Assignees: Hitachi, Ltd., Tokyo (JP); Fujitsu Hitachi Plasma Display Ltd., Kanagawa (JP)

( * ) Notice: Subject to any disclaimer, the term of this patent is extended or adjusted under 35 U.S.C. 154(b) by 267 days.

(21) Appl. No.: 10/222,583

(22) Filed: Aug. 19, 2002

(65) Prior Publication Data

US 2003/0218579 A1 Nov. 27, 2003

(30) Foreign Application Priority Data

May 27, 2002 (JP) ..... 2002-151992

(51) Int. Cl.[7] ..... G09G 3/28
(52) U.S. Cl. ..... 345/60; 313/581
(58) Field of Search ..... 345/60, 62, 63, 345/67, 65, 66, 68, 78, 88, 87; 313/581, 493, 582, 584, 585, 586; 315/188.7, 169.3

(56) References Cited

U.S. PATENT DOCUMENTS 3,886,393 A * 5/1975 Hinson ..... 313/572
3,904,915 A * 9/1975 Hinson ..... 313/484
3,925,697 A * 12/1975 Fein et al. ..... 313/485
4,461,978 A * 7/1984 Mikoshiba et al. ..... 315/169.4
4,574,199 A * 3/1986 Pryor ..... 250/559.33
5,770,921 A * 6/1998 Aoki et al. ..... 313/581
6,097,357 A * 8/2000 Shinoda et al. ..... 345/63
6,107,739 A * 8/2000 Ha ..... 313/582
6,118,229 A 9/2000 Lee ..... 315/307
6,285,129 B1 * 9/2001 Park et al. ..... 313/586
6,291,943 B1 * 9/2001 Murai et al. ..... 315/188

FOREIGN PATENT DOCUMENTS

| | | |
|---|---|---|
| JP | 6-342631 | 12/1994 |
| JP | 11-103431 | 4/1999 |
| JP | 2000-67758 | 3/2000 |

OTHER PUBLICATIONS

N. Uemura et al., "Kinetic Model of the VUV Production in AC–PDPs as Studied by Time–resolved Emission Spectroscopy", Proceedings of IDW '00 (The 7$^{th}$ International Display Workshops), 2000, pp. 639–642.

* cited by examiner

*Primary Examiner*—Vijay Shankar
*Assistant Examiner*—Prabodh M. Dharia
(74) *Attorney, Agent, or Firm*—Miles & Stockbridge P.C.

(57) ABSTRACT

There are provided a plasma display panel and an imaging device which realize a high luminous efficiency, guaranteed long lifetime and stable driving. The plasma display panel uses a discharge-gas mixture containing at least Xe, Ne and He. A Xe proportion of the discharge-gas mixture is in a range of from 2% to 20%, a He proportion of the discharge-gas mixture is in a range of from 15% to 50%, the He proportion is greater than the Xe proportion, and a total pressure of the discharge-gas mixture is in a range of from 400 Torr to 550 Torr. A width of a voltage pulse to be applied to an address electrode is 2 $\mu$s or less.

8 Claims, 9 Drawing Sheets

PLASMA DISPLAY PANEL AND IMAGING DEVICE USING THE SAME

FIELD OF THE INVENTION

The present invention relates to a plasma display panel and an imaging device using the same.

BACKGROUND OF THE INVENTION

In recent years, plasma display panels (hereinafter referred to as "PDPs") have attracted considerable attention as large- and flat-screen and low-profile display devices. At the present, ac-drive coplanar-discharge type PDPs (hereinafter referred to as "ac coplanar-discharge type PDPs") are dominant. The ac coplanar-discharge type PDP is an imaging device having a large number of small discharge spaces (discharge cells) sealed between a pair of glass substrates.

In the PDP, plasma is created by discharge of gases (discharge gases) contained in the discharge cells, and ultraviolet rays from the plasma excite phosphors to emit visible light and thereby to form an image display. There is another method of forming an image display by using a light emission directly from the plasma.

Rare gases (particularly a mixture of Ne and Xe gases) have been chiefly used as discharge gases, one of materials of the plasma display devices. Japanese Patent Application Laid-Open No. Hei 6-342631 (laid open on Dec. 13, 1994) discloses the use of a mixture of three gases He, Ne and Xe. Here, the ratio in volume of He to Ne is selected in a range of from 6/4 to 9/1, and Xe is selected in a range of from 1.5% to 10% by volume of the total of the discharge gases. However, there is a problem in that an excessive amount of He shortens lifetime of the display device. Japanese Patent Application Laid-Open No. 2000-67758 (laid open on Mar. 3, 2000) discloses a technique which controls crosstalk between adjacent discharge cells by using a mixture of three gases He, Ne and Xe and thereby increases a drive margin of a sustaining voltage. Japanese Patent Application Laid-Open No. Hei 11-103431 (laid open on Apr. 13, 1999) discloses a technique which realizes a long lifetime, stable driving voltages and proper brightness properties by using a mixture of three gases He, Ne and Xe with He and Xe being equal in concentration. It has been reported in N. Uemura, et al. "Kinetic Model of the VUV Production in AC-PDPs as Studied by Time-resolved Emission Spectroscopy," Proceedings of IDW '00 (The 7$^{th}$ International Display Workshops), pp. 639–642 (2000)" that ultraviolet ray generation efficiency is improved by using a mixture of three gases He, Ne and Xe.

Improvement in luminous efficiency (lm/W) is desired in development of PDPs. The luminous efficiency is determined by initially dividing a brightness value (or a luminance) (cd/m$^2$) by an electric power (W/m$^2$) required to excite a unit area to provide the above brightness value, and then correcting the obtained quotient by using a solid angle (steradian) subtended by a measurement system as viewed from the light source. Since a discharge gas has a great influence on generation of ultraviolet rays, its setting is important for the improvements of the luminous efficiency. The conditions of plasma change greatly depending upon the composition and pressure of the discharge gas, and consequently, the luminous efficiency also changes greatly. However, in the case of developing a plasma display intended for practical use, the plasma display should be excellent in other performances comprehensively as well as the improvement of the luminous efficiency. When the composition and pressure of the discharge gas are changed to improve the luminous efficiency, lifetime may be shortened, and driving may be unstable. Further, for practical use, high definition, high brightness, low cost and so forth are strongly demanded. Thus, it is necessary to take into consideration other conditions (driving conditions, cost, etc.) in addition to the composition and pressure of the discharge gas, in the development of the plasma display of practical use.

SUMMARY OF THE INVENTION

The present invention provides a PDP capable of improving luminous efficiency, guaranteeing long lifetime, and being driven stably. Further, the PDP in accordance with the present invention makes possible a high-brightness, high-definition and low-price display device.

To solve the above problems, the features of the present invention include selection of the composition and total pressure of the discharge gas, the pulse width of a write voltage and so forth. Such features contribute to the improved luminous efficiency, guaranteed long lifetime, and elimination of instability in driving.

In the present invention, (1) a discharge-gas mixture containing at least three components of Ne, Xe and He is used, and component proportions of the discharge-gas mixture and a pressure of the discharge-gas mixture and a pulse width for write-discharge are selected as follows.

Conditions for the discharge-gas mixture are as follows:

(2) A Xe proportion is in a range of from 2% to 20%, a He proportion is in a range of from 15% to 50%, wherein (4) the He proportion is greater than the Xe proportion, and (5) a total pressure of the discharge-gas mixture is in a range of from 400 Torr to 550 Torr.

Further, (6) a width of voltage pulses to be applied to address electrodes is 2 $\mu$s or less.

Further, the present invention become more practical if it is configured as below.

In a second embodiment of the present invention, a discharge-gas mixture contains a Xe proportion in a range of from 2% to 14% and a He proportion in a range of from 15% to 50% with the He proportion being greater than the Xe proportion; a total pressure of the discharge-gas mixture is in a range of from 400 Torr to 550 Torr; and a width of voltage pulses to be applied to address electrodes is 2 $\mu$s or less. The present embodiment is capable of realizing a PDP which is more advantageous in practical use. A sustaining discharge voltage is increased if the Xe proportion is selected to be much greater than 14%.

In a third embodiment of the present invention, a discharge-gas mixture contains a Xe proportion in a range of from 6% to 14% and a He proportion in a range of from 15% to 50% with the He proportion being greater than the Xe proportion; a total pressure of the discharge-gas mixture is in a range of from 400 Torr to 550 Torr; and a width of voltage pulses to be applied to address electrodes is 2 $\mu$s or less. This embodiment realizes a PDP which provides particularly high brightness and excellent luminous efficiency.

In a fourth embodiment of the present invention, a discharge-gas mixture contains a Xe proportion in a range of from 6% to 12% and a He proportion in a range of from 15% to 50% with the He proportion being greater than the Xe proportion; a total pressure of the discharge-gas mixture is in a range of from 400 Torr to 550 Torr; and a width of voltage pulses to be applied to address electrodes is 2 $\mu$s or less. Advantages achieved by the He proportion is particularly pronounced for the above Xe proportion, and the luminous efficiency is improved effectively to realize a high-brightness PDP.

Needless to say, the PDP of the present invention provides an imaging device capable of the above characteristics.

BRIEF DESCRIPTION OF THE DRAWINGS

In the accompanying drawings, in which like reference numerals designate similar components throughout the figures, and in which.

DETAILED DESCRIPTION OF THE PREFERRED EMBODIMENTS

Basic Structure and Operation

Figure 1:
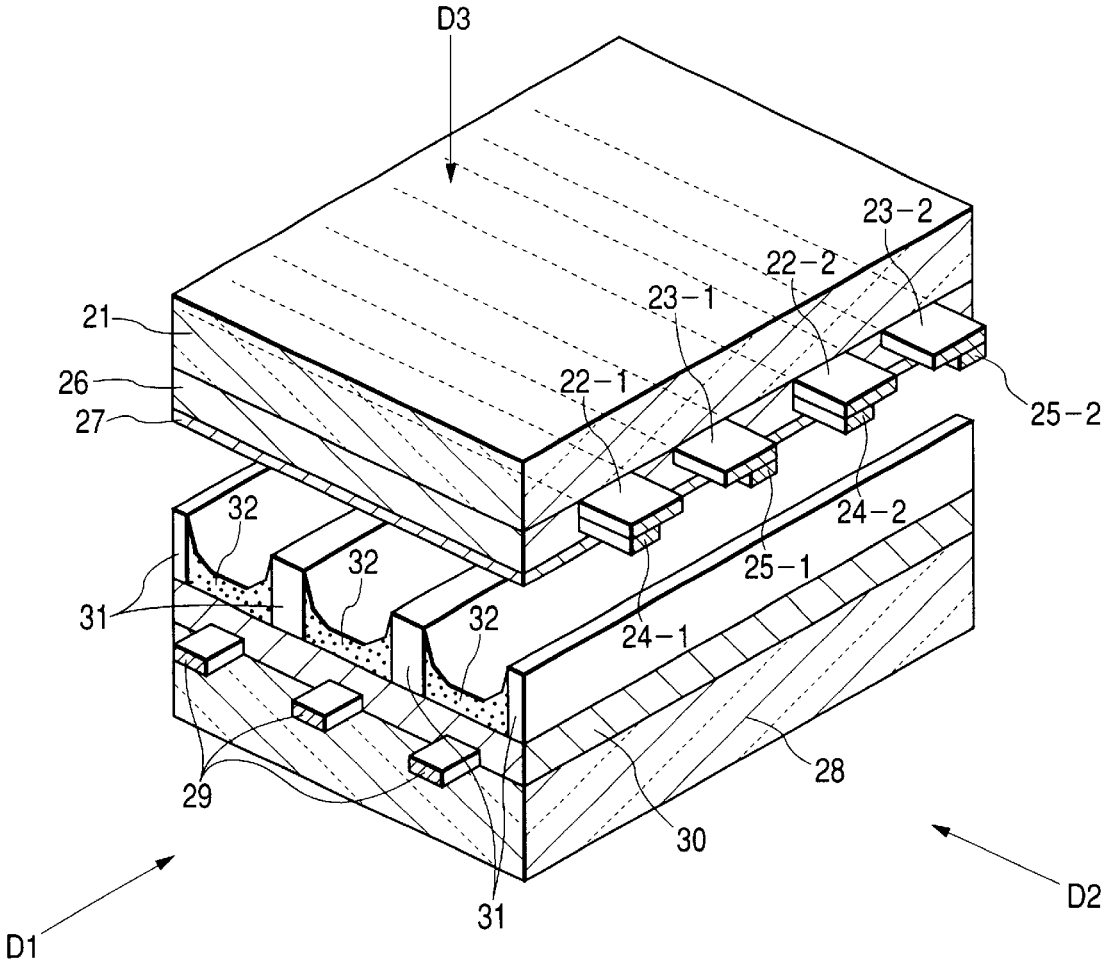
FIG. 1 is an exploded perspective view showing a part of a PDP to which the present invention is applied.

An ac coplanar-discharge type PDP is an imaging device having a large number of small discharge spaces (discharge cells) sealed between a pair of glass substrates.

The embodiments will be explained with reference to the accompanying drawings. The same reference numerals designate corresponding or functionally similar parts or portions throughout the figures, and repetition of their explanations is omitted.

FIG. 1 is an exploded perspective view illustrating a part of a structure of a typical ac coplanar-discharge type PDP by way of example. The PDP shown in FIG. 1 has a front panel 21 and a rear panel 28 which are made of glass and affixed together in an integrated manner. The present example is a reflection type PDP in which phosphor layers 32 of red (R)-, green (G)-, and blue (B)-color phosphors are formed on the rear panel 28. The front panel 21 has a plurality of pairs of sustaining discharge electrodes (sometimes referred to as "display electrodes") arranged in parallel with each other with a specified spacing therebetween on its surface facing the rear panel 28. Each of the plurality of pairs of sustaining discharge electrodes comprises one of mutually-connected transparent electrodes (hereinafter referred to merely as X electrodes) (22-1, 22-2, . . . ) and one of independent transparent electrodes (hereinafter referred to merely as Y electrodes or scanning electrode) (23-1, 23-2, . . . ). For the purpose of supplementing electric conductivity of the transparent X, Y electrodes, the X electrodes (22-1, 22-2, . . . ) and the Y electrodes (23-1, 23-2, . . . ) are overlaid with opaque X bus electrodes (24-1, 24-2, . . . ) and opaque Y bus electrode (25-1, 25-2, . . . ) extending in a direction of an arrow D2 indicated in FIG. 1, respectively.

For the ac driving, the X electrodes (22-1, 22-2, . . . ), Y electrodes (23-1, 23-2, . . . ), X bus electrodes (24-1, 24-2, . . . ) and Y bus electrodes (25-1, 25-2, . . . ) are insulated from the discharge. More specifically, each of these electrodes is coated with a dielectric layer 26 typically made of a low melting point glass, and the dielectric layer 26 is covered with a protective film 27.

The rear panel 28 is provided with address electrodes 29 (hereinafter referred to merely as "A electrodes") extending in a direction of an arrow D1 indicated in FIG. 1 on its surface facing the front panel 21, and the A electrodes are spaced from and extending perpendicularly to the X electrodes (22-1, 22-2, . . . ) and the Y electrodes (23-1, 23-3, . . . . ) formed on the front panel 21, and are covered with a dielectric layer 30.

Ribs 31 are provided on the dielectric layer 30 to separate the A electrodes 29 from each other, and thereby to prevent spread of discharge (and hence define an area of the discharge). In some cases, ribs extending in the direction of the arrow D2 are provided to separate the pairs of X and Y sustaining-discharge electrodes from each other.

Red-, green-, and blue-light emitting phosphor layers 32 are coated sequentially in the shape of stripes on surfaces of corresponding grooves formed between the ribs 31.

Figure 2:
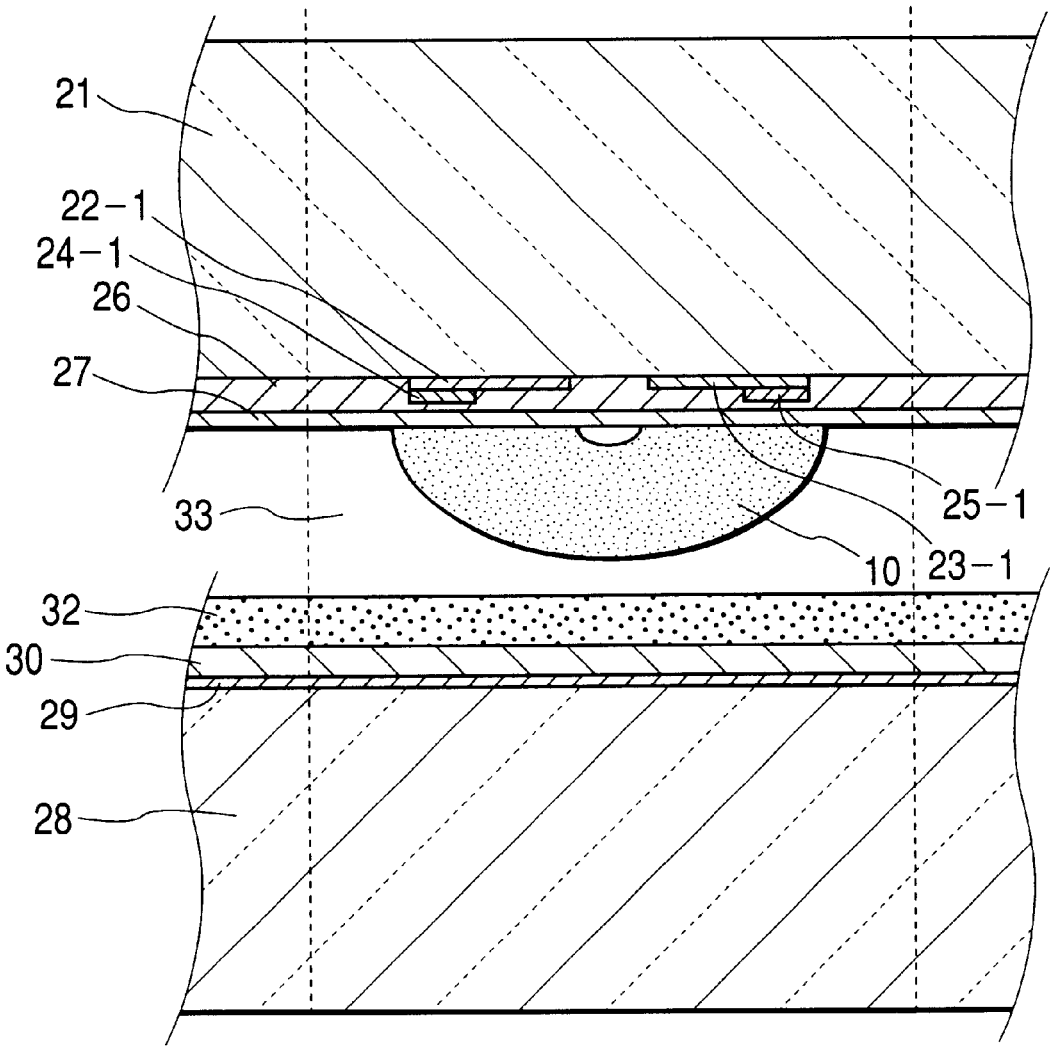
FIG. 2 is a cross-sectional view showing a cross-sectional structure of a main part of the PDP of FIG. 1 as viewed in a direction D2 indicated in FIG. 1, and showing one discharge cell.

FIG. 2 is a cross-sectional view of a main part of the PDP as viewed in the direction of the arrow D2 in FIG. 1, and illustrate one discharge cell serving as the smallest picture element. In FIG. 2, boundaries of the discharge cell is schematically indicated by broken lines. Reference numeral 33 denotes a discharge space filled with a discharge gas for generating plasma. When a voltage is applied between the electrodes, plasma 10 is generated by ionization of the discharge gas. FIG. 2 is a cross-sectional view schematically showing a condition in which the plasma 10 is generated. The same reference numerals as utilized in FIG. 1 designate corresponding portions in FIG. 2. Ultraviolet rays from the plasma 10 excite the phosphors 32 to emit light, and light from the phosphors 32 passes through the front panel 21 such that an image display is produced by a combination of lights from the respective discharge cells.

Figure 3:
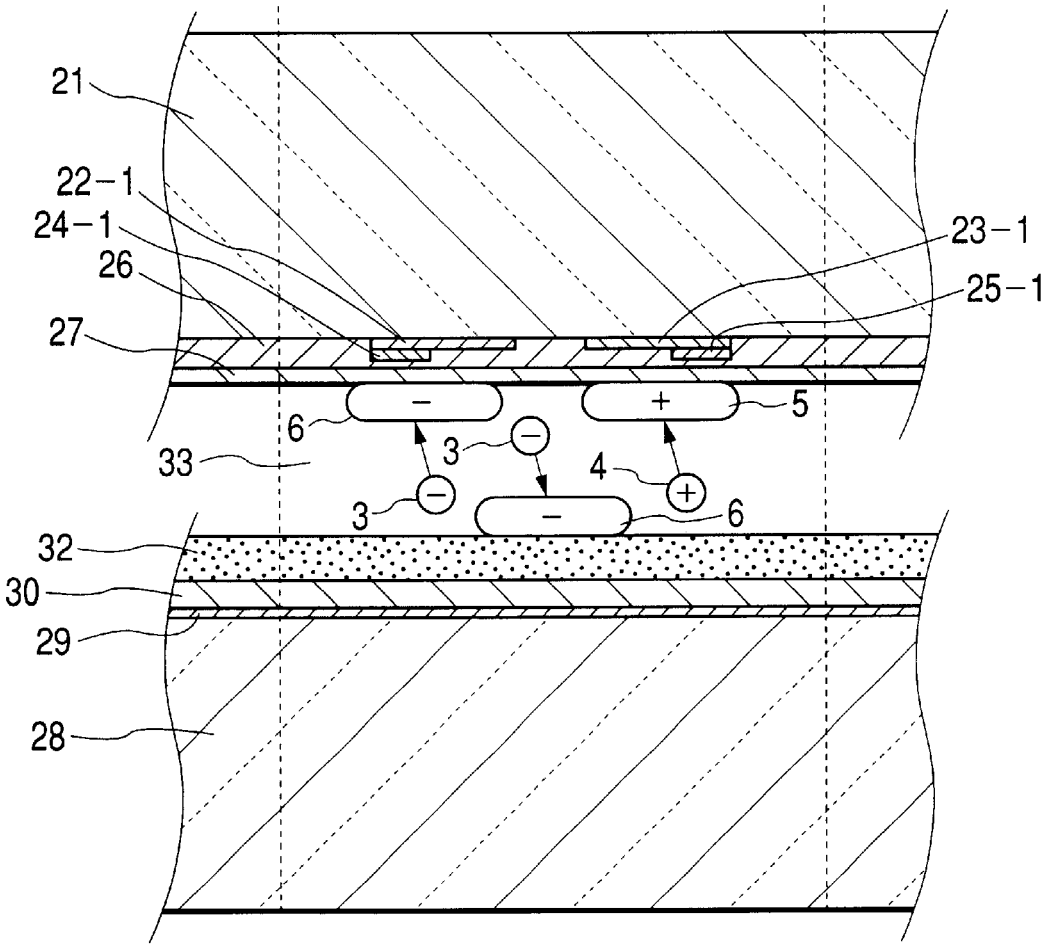
FIG. 3 is a cross-sectional schematic showing movements of charged particles (positive and negative particles) in plasma 10 shown in FIG. 2.

FIG. 3 is a schematic illustration of movements of charged particles (positive or negative particles) in the plasma 10 shown in FIG. 2. Reference numeral 3 denote negative particles (e.g., electrons), reference numeral 4 denotes a positive particle (e.g., a positive ion), reference numeral 5 denotes a positive wall charge and reference numeral 6 denote negative wall charges. FIG. 3 illustrates a state of charges at an instant of time during operation of the PDP, and the arrangement of the charges in FIG. 3 does not have any particular meaning.

FIG. 3 is a schematic illustration showing, by way of example, a state in which discharge was started by applying a negative voltage to the Y electrode 23-1 and a relatively positive voltage to both the A electrode 29 and the X electrode 22-1, and thereafter the discharge has ceased. As a result, formation of wall charges (which is called "writing") has been performed which assists start of discharge between the Y electrode 23-1 and the X electrode 22-1. When an appropriate inverse voltage is applied between the Y electrode 23-1 and the X electrode 22-1 in this state, discharge occurs in a discharge space between the X, Y electrodes via the dielectric layer 26 (and the protective film 27). After cessation of the discharge, when the voltage applied between the Y electrode 23-1 and the X electrode 22-1 are reversed, another discharge occurs. The discharge can be produced continuously by repeating the reversal of the polarity of the voltage applied between the X, Y electrodes 22-1, 23-1. This is called a sustaining discharge.

In the sustaining discharge, the ease of starting the discharge is sometimes influenced by proportions of charged particles and excited neutral particles (mainly long-lifetime particles in a metastable state) floating in the discharge space. The above-mentioned charged particles and excited neutral particles may sometimes be referred to collectively as priming particles.

Figure 4A:
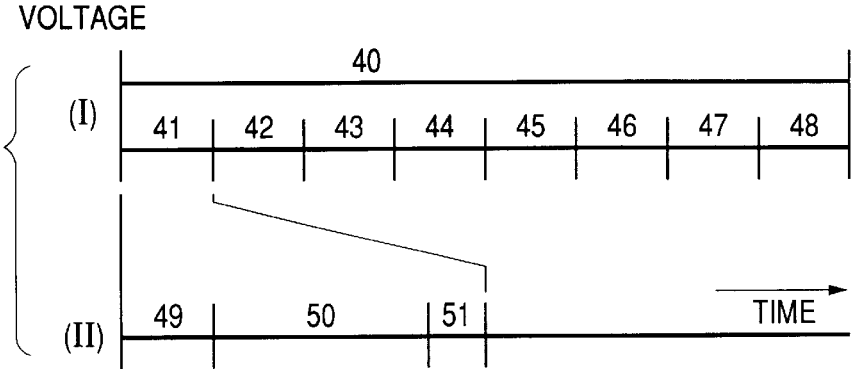
FIGS. 4A to 4C are time charts each showing operation in one TV field period for displaying a picture on a PDP.
Figure 4B:
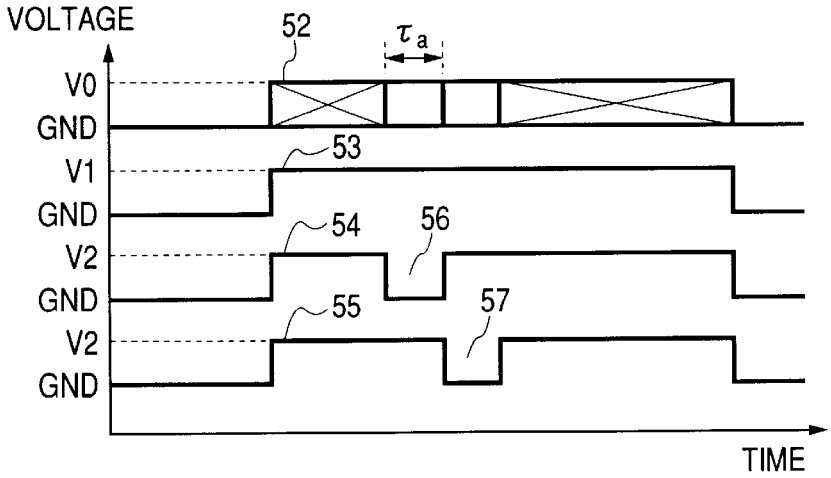
Figure 4C:
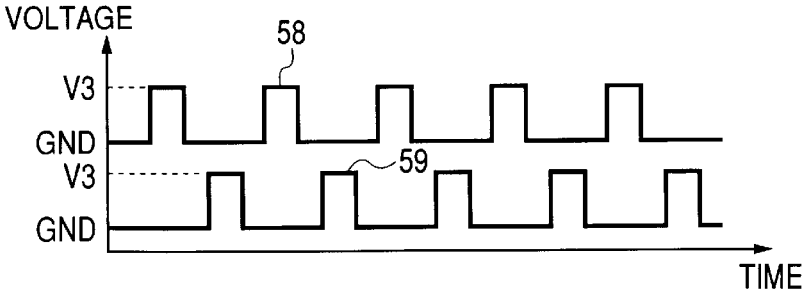

FIGS. 4A to 4C are time charts for explaining an operation during one TV field period required for displaying one picture on the PDP shown in FIG. 1. In the time chart of FIG. 4A, as shown in (I), one TV field period 40 is divided into eight sub-fields 41 to 48 having different numbers of light emission more than one, from one another. Each of gray scales is represented by a combination of one or more light-emitting sub-fields selected among the eight sub-fields 41 to 48. As shown in (II), each of the sub-fields has a reset-discharge period 49, a write-discharge period 50 for determining a light-emitting cell, and a sustaining discharge period 51.

FIG. 4B shows voltage pulse profiles applied to the A electrodes, X electrodes and Y electrodes during the write-discharge period 50 of FIG. 4A. A voltage pulse profile 52 is a waveform of a voltage applied to one of the A electrodes during the write-discharge period 50, a voltage pulse profile 53 is a waveform of a voltage applied to the X electrodes, and voltage pulse profiles 54 and 55 are waveforms of voltages applied to the i-th and (i+1)th Y electrodes, respectively, and the above voltages are denoted by V0, V1 and V2(V), respectively. In FIG. 4B, a width of voltage pulses applied to the A electrodes is indicated by $\tau_a$. In FIG. 4B, when a scan pulse 56 is applied to the i-th Y electrode, a write-discharge occurs in a cell at an intersection of the i-th Y electrodes and the A electrode 29. However, even when the scan pulse 56 is applied to the i-th Y electrodes, the write-discharge does not occur if the A electrode 29 is at ground potential (GND). In this way, the scan pulse 56 is applied to one Y electrode during the write-discharge period 50, and in synchronism with the scan pulse 56, the A electrode 29 of a cell intended to produce light is supplied with the voltage V0, and the A electrode of other cells not intended to produce light are set at ground potential. In the discharge cell where the write-discharge has occurred, the charges are produced on the dielectric layer and the protective film covering the Y electrodes by the write-discharge. With the aid of an electric field generated by the write-charge, on-or-off control of the sustaining discharge can be obtained as described later in this specification. That is to say, the discharge cells having produced the write discharge serves as light emitting cells and the remainder of the cells serves as dark cells.

FIG. 4C shows voltage pulses applied all of the X electrodes and Y electrodes which serve as the sustaining discharge electrodes during the sustaining discharge period 51 in FIG. 4A. A voltage pulse profile 58 is applied to the X electrodes and a voltage pulse profile 59 is applied to the Y electrodes. Voltage pulses V3 (V) of the same polarity are applied alternately to the X electrodes and the Y electrodes, and consequently, reversal of the polarity of the voltage between the X and Y electrodes is repeated. A discharge in a discharge gas between the X electrodes and the Y electrodes generated by the voltage pulses is called sustaining discharge. The sustaining discharges are pulsating and alternating in polarity.

Diagonal screen dimensions of currently available PDPs include 32 inches, 42 inches and 60 inches, for example. A discharge gap in such a large-sized PDPs is generally in a range of from 50 to 150 $\mu$m. The present invention is sufficiently applicable to such conventional PDPs.

Hereinbefore, the basic PDP structure to which the present invention is applicable has been described by way of example. The present invention will now be described in detail through embodiments of the present invention based on the above-described basic PDP structure.

The present invention will be described with reference to results shown in graphs of FIGS. 5 to 7. The measurements of luminous efficiency (lm/W) were made by using the above-explained basic PDP structure and introducing mixtures of three gases Ne, Xe and He as discharge gases into the discharge space 33, varying the compositions of the discharge gas mixtures. In this embodiment, the discharge gas mixtures comprise Ne, Xe and He, but a small amount of impurity gases may sometimes be contained in the discharge gas mixtures. However, even in such cases, the characteristics of the present invention can be secured.

The measurements were conducted for 35 proportion combinations of Xe, He and Ne, in which proportions of Xe are 2%, 4%, 6%, 8%, 12%, 14% and 20%, those of He are 0%, 10%, 15%, 30% and 50%, and those of Ne is the balance. A total pressure of each of the 35 proportion combinations was set at 500 Torr. The proportions of Ne are not indicated in FIGS. 5 to 7, and those are the balance of the compositions.

The proportions of gases of a gas mixture can be defined and measured in the following manner.

A proportion of a constituent $\alpha$ of the discharge-gas mixture is defined as below:

The proportion of the constituent $\alpha = N\alpha/Nt$ . . . (1), where $N\alpha$=the number of particles (atoms or molecules) of the constituent $\alpha$ per unit volume of the discharge-gas mixture, expressed in atoms/$m^3$, or molecules/$m^3$, for example, and Nt=the number of all the particles (atoms or molecules) per unit volume of the discharge-gas mixture, expressed in atoms/$m^3$, or molecules/$m^3$, for example.

The above-defined proportion of the constituent $\alpha$ can be rewritten in the following form in accordance with a physical law and can be measured.

The proportion of the constituent $\alpha = P\alpha/Pt$ . . . (2), where

Pα=a partial pressure of a constituent gas α of the discharge-gas mixture, and

Pt=a total pressure of the discharge-gas mixture.

The partial and total pressures can be expressed in Torr, for example. The total pressure can be measured by using a pressure gauge. The partial pressures of the respective constituent gases of the discharge-gas mixture and the total pressure can be measured by analyzing constituent gases using a mass spectrograph, for example.

Figure 5:
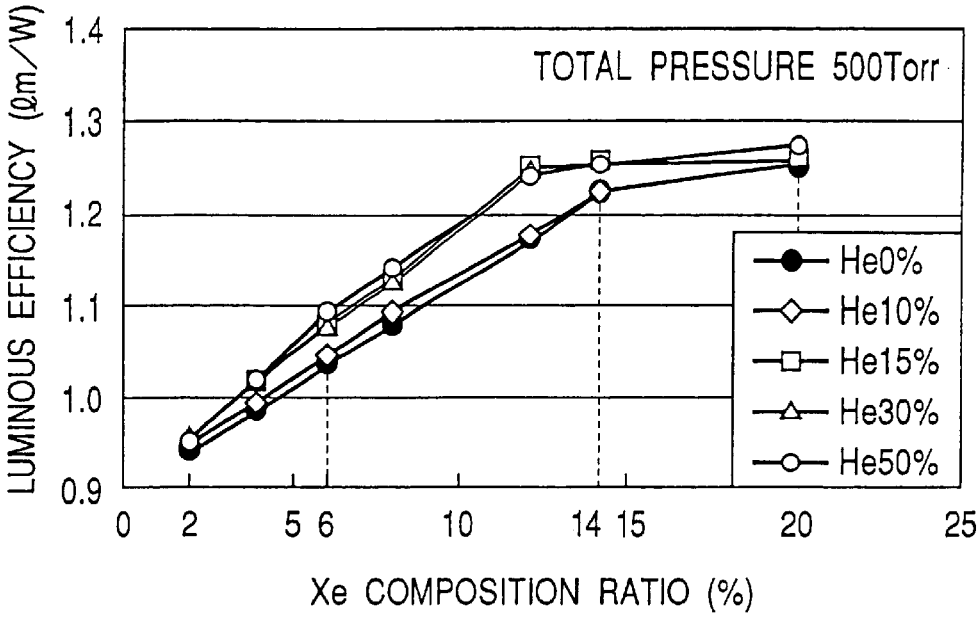
FIG. 5 is a graph showing results obtained by measurements of luminous efficiencies using three-component discharge-gas mixtures of Ne, Xe and He for their various proportions in Embodiments.

As is apparent from FIG. 5, the luminous efficiency is improved as the Xe proportion is increased. However, if the Xe proportion exceeds 20%, the PDP cannot be driven without increasing the sustaining discharge voltage greatly as explained later. Therefore, the discharge-gas mixture containing the Xe proportion in excess 20% is not practical.

Figure 8:
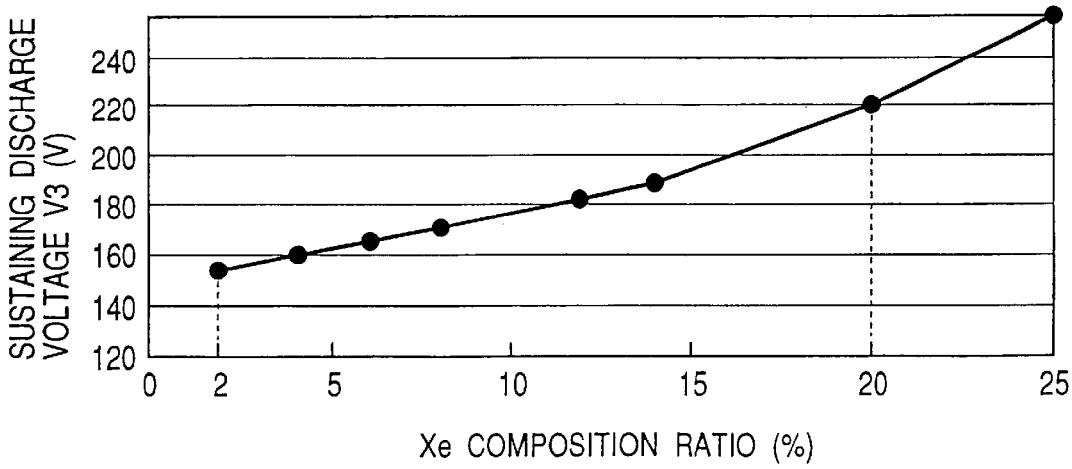
FIG. 8 is a graph showing changes in sustaining discharge voltage when the Xe proportion is changed.

FIG. 8 shows a plot of sustaining discharge voltage V3 against Xe proportions. The sustaining discharge voltages increase greatly when the Xe proportion exceeds 20%. Therefore, the Xe proportion in excess of 20% is of little real use. On the other hand, if the Xe proportion is smaller than 2%, the luminous efficiency itself becomes too low for practical use. While the plot of FIG. 8 is obtained by setting the total pressure of the discharge-gas mixture at 500 Torr and the He proportion at 0%, the sustaining discharge voltage V3 does not vary much even if He is added to the discharge-gas mixture, and depends only on the Xe proportions. Therefore, also under other conditions in accordance with the present invention, it is preferable that the Xe proportion is in a range of from 2% to 20%.

Thus, the Xe proportions in the range of from 2% to 20% is preferred in view of the luminous efficiency and sustaining discharge voltage.

Returning now to FIG. 5, reference values for evaluating improvement in luminous efficiencies are taken to be the luminous efficiencies of the discharge-gas mixtures having the 0% He proportion (Ne—Xe binary systems), and the ratios of the luminous efficiencies to the respective reference values are calculated for the respective Xe proportions with the He proportions 10%, 15%, 30%, 50% as parameters. The calculated ratios expressed in % shall be called "improvement rate of luminous efficiencies" in this specification. FIG. 6 shows the "improvement rate of luminous efficiencies" plotted as ordinates with the Xe proportions plotted as abscissas. FIG. 7 shows the "improvement rate of luminous efficiencies" plotted as ordinates with the He proportions plotted as abscissas.

Figure 6:
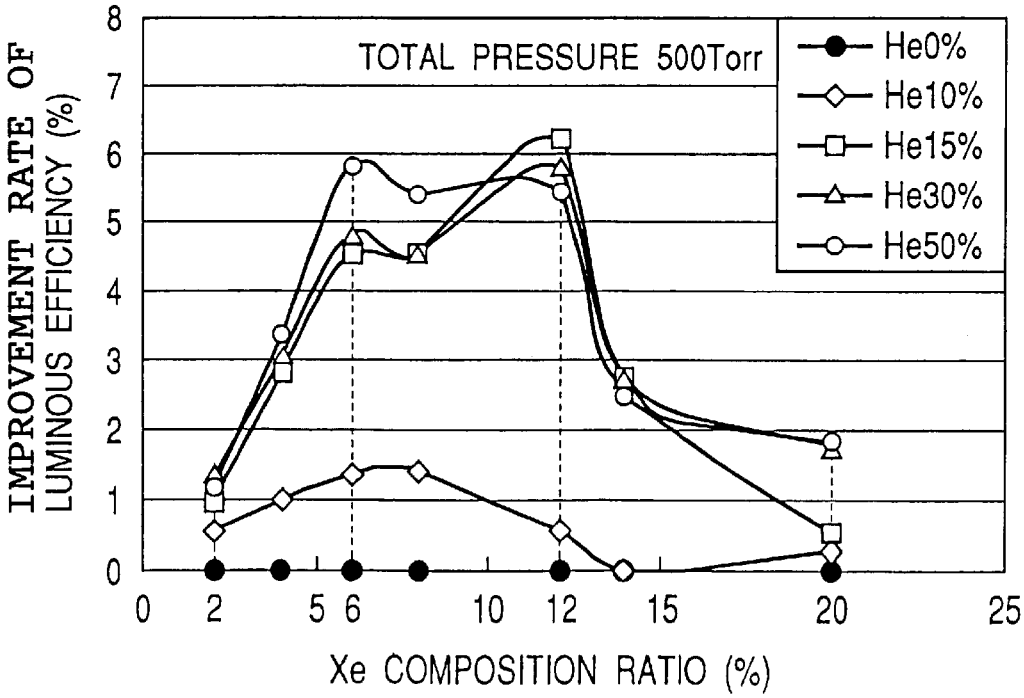
FIG. 6 is a graph showing results obtained by measurements of characteristics of improvement rate of luminous efficiency versus Xe proportion using three-component discharge-gas mixtures of Ne, Xe and He for their various proportions in the Embodiments.

As apparent from FIG. 6, the luminous efficiency is improved greatly for the He proportions in a range of from 15% to 50%. That is to say, for the Xe proportions in a range of from 2% to 20%, the luminous efficiencies are further improved by an effect of adding He gas of the proportions in a range of from 15% to 50% to the discharge-gas mixture.

However, as described above, the sustaining discharge voltage needs to be increased if the Xe proportion is increased. Further, as is apparent from FIG. 5, the improvement rate of luminous efficiency increasing with increasing Xe proportion tends to saturate when the Xe proportion is 20%. Therefore, in view of the sustaining discharge voltage and the improvement rate of luminous efficiency, it can be said that a preferable practical gas composition of the discharge-gas mixture contains the He proportion in a range of from 15% to 50% in addition to the Xe proportion in a range of 2% to 14%.

In the above preferred gas composition, particularly if the Xe proportion is selected to be 6% or more, the absolute value of the obtained luminous efficiency is as high as 1.1 lm/W or more (though not shown in FIG. 6, a peak brightness value exceeds 1000 cd/m$^2$). Therefore, a discharge-gas mixture containing an Xe proportion in a range of from 6% to 14% and a He proportion in a range of from 15% to 50% is capable of realizing a PDP which provides a high-brightness and a high-luminous-efficiency.

Figure 7:
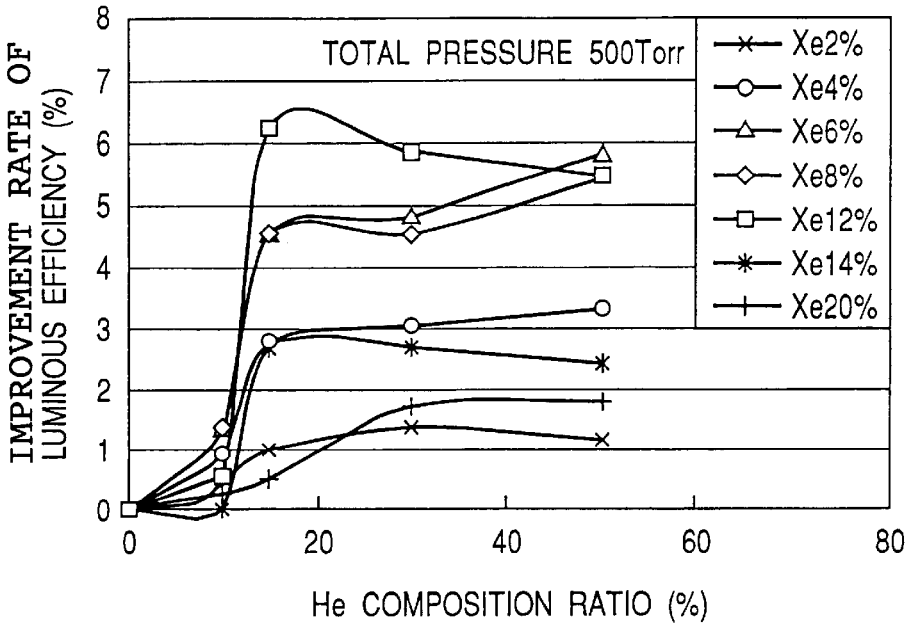
FIG. 7 is a graph showing results obtained by measurements of characteristics of improvement rate of luminous efficiency versus He proportion using three-component discharge-gas mixtures of Ne, Xe and He for their various proportions in the Embodiments.

Further, apparent from FIG. 7, the degree of the effects provided by addition of He depends upon Xe proportions. The addition of He is especially effective when the Xe proportion is in a range of from 6% to 12%. Therefore, when a PDP utilizes the discharge-gas mixture containing the He proportion in a range of from 15% to 50% in addition to the Xe proportion in a range of from 6% to 12%, a high-brightness PDP having a luminous efficiency especially improved can be realized by the effects of the He gas.

What is more, the following facts are found through the analysis of FIG. 6 in terms of He and Xe proportions. It is found that the luminous efficiency sharply decreases at the Xe proportion of 20% for the He proportion of 15% as compared with that of the He proportions of 30% and 50%. Further, it is found that the luminous efficiency sharply decreases when the Xe proportion is increased from 12% to 14% to 20%, for the 10% He proportion, though the 10% He proportion is scarcely effective. In short, the effect of adding He to the discharge-gas mixture is pronounced when the He proportion is greater than the Xe proportion. Therefore, in the case of using He and Xe in combination, it is important to select the He proportion to be greater than the Xe proportion.

The above results can be explained by using the following model. The reason why the luminous efficiency is improved by the addition of He is that a cascade transition to an excited state of Xe, which generates ultraviolet rays, is increased by the addition of He. The cascade transition process itself has been reported in, for example, "Proceedings of IDW '00 (The 7$^{th}$ International Display Workshops), p. 639 (2000)". The cascade transition is increased because the number of excited atoms in the initial state of the cascade transition is increased by impact transitions with He. Therefore, the effect of the addition of He is pronounced when the number of He atoms is larger than a certain value, or when the number of He atoms is larger than that of Xe atoms, and, in other words, when the He proportion is greater than the Xe proportion.

The effect of the addition of He with respect to the Xe proportion is similar to the above case, in cases where the total pressure is 400 and 550 Torr. More specifically, the luminous efficiency is improved by the effect of He when He of the proportion in a range of from 15 to 50% is added to Xe of the proportion in a range of from 2 to 20% under the above total pressure. Also, a discharge-gas mixture having an Xe proportion in a range of from 2% to 14% and an He proportion in a range of from 15% to 50% is more practical in view of the sustaining discharge voltage and the improvement rate of luminous efficiency. The discharge-gas mixture having the Xe proportion in a range of from 6% to 14% and mixed with the He proportion in a range of from 15% to 50% is capable of realizing a PDP which provides a very high brightness and an excellent luminous efficiency. Further, the effect of addition of He is particularly enhanced if the discharge-gas composition having the Xe proportion in a range of from 6% to 12% and mixed with the He proportion in a range of from 15% to 50% is used, and thereby a PDP can be realized which provides high brightness. The effect of addition of He is pronounced when the He proportion is greater than the Xe proportion.

The following conclusions are drawn from the above embodiment.

The luminous efficiency is improved by the effect of He when the He proportion in a range of from 15% to 50% is added to the discharge-gas mixture containing the Xe proportion in a range of from 2% to 20% such that the He proportion is greater than the Xe proportion.

The gas composition having the Xe proportion in a range of from 2% to 14% and mixed with the He proportion in a range of from 15% to 50% such that the He proportion is greater than the Xe proportion, is more practical in view of discharge sustaining voltages and the improvement rate of luminous efficiency.

Further, by the use of the discharge-gas mixture having the Xe proportion in a range of from 6% to 14% and mixed with the He proportion in a range of from 15% to 50% such that the He proportion is greater than the Xe proportion, it is possible to realize a PDP which has provides particularly high brightness and excellent luminous efficiency.

What is more, by the use of the discharge-gas mixture having the Xe proportion in a range of from 6% to 12% and mixed with the He proportion in a range of from 15% to 50% such that the He proportion is greater than the Xe proportion, the luminous efficiency is particularly improved by the effect of He and a high-brightness PDP is realized.

Next, lifetime of the PDP will be discussed. The luminous efficiency is improved by the addition of He, but an addition of an excess amount of He causes the problem of shorting lifetime. Lifetime is evaluated by using relative values of brightness decreasing with time during a long period of time when a PDP is operated continuously. More specifically, a brightness value at a zero hour of operation of the PDP is taken to be 1.0, and relative values of brightness after the zero hour are evaluated as brightness maintenance ratios. In general, lifetime in a range of from 20,000 to 30,000 hours should be guaranteed, but the evaluation was performed for about 600 hours of operation because changes in the brightness maintenance ratio occurring thereafter can be estimated easily by using the data measured for about 600 hours of operation.

Figure 9:
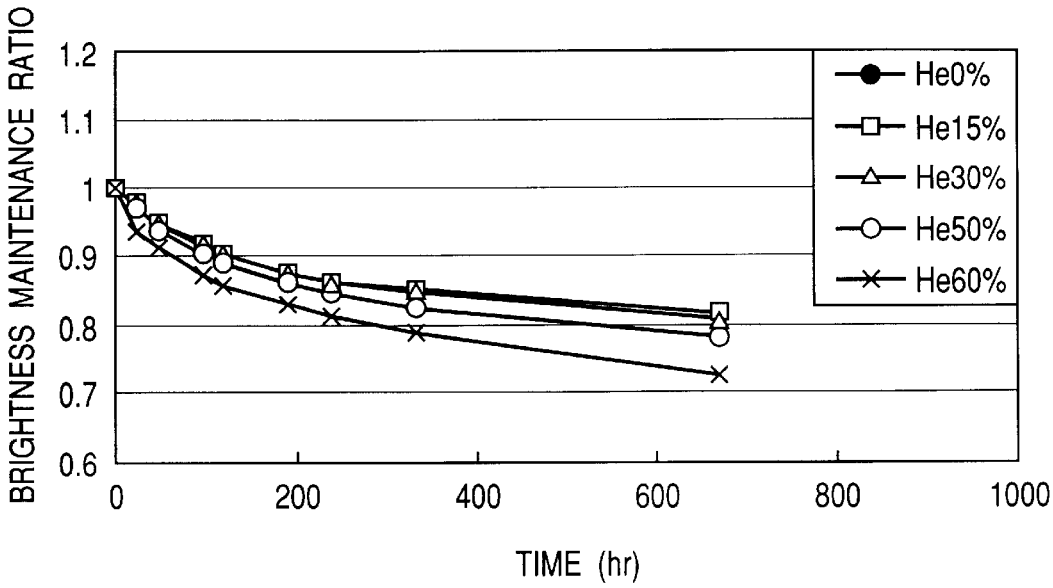
FIG. 9 is a graph showing changes in brightness maintenance ratio with operation time when the He proportion is changed.
Figure 10:
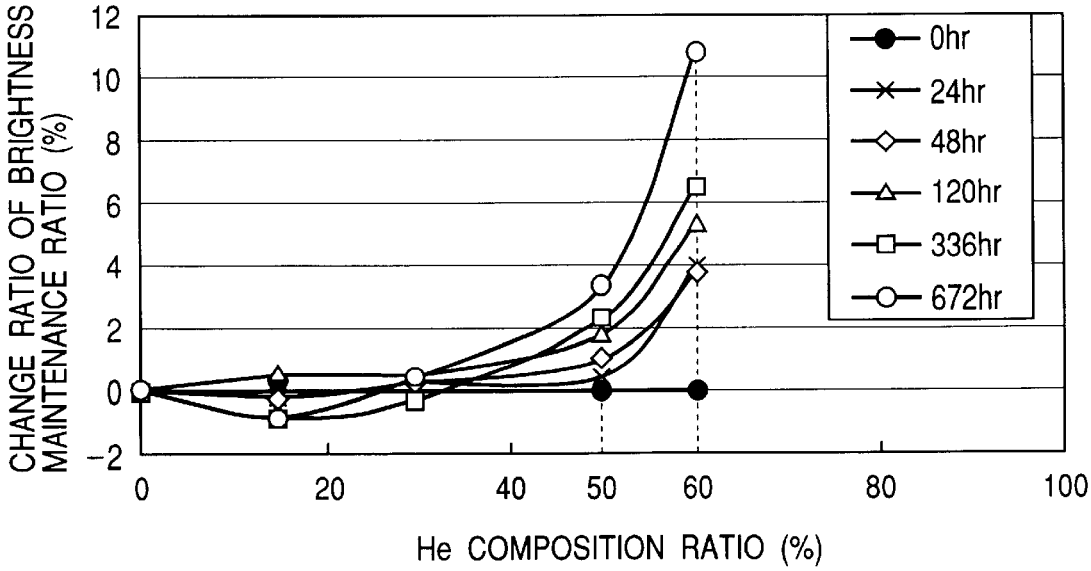
FIG. 10 is a graph showing a relationship between He proportions and change ratio in brightness maintenance ratio.

FIGS. 9 and 10 show results of experiments of lifetime evaluations of the present invention. FIG. 9 shows the brightness maintenance ratios measured on the various discharge-gas mixtures containing the Xe proportion of 8% with the He proportions of 0%, 15%, 30%, 50% and 60%, respectively, and with the total pressures being kept at 500 Torr. Next, reference values for evaluating the brightness maintenance ratios are taken to be the measured brightness values of the discharge-gas mixtures having the 0% He proportion (the Ne—Xe binary systems), and the ratios of the measured brightness maintenance ratios to the respective reference values are calculated for the discharge-gas mixtures having the He proportions of 0%, 15%, 30%, 50%, and 60%, respectively. The calculated ratios expressed in % shall be called "change ratio of brightness maintenance ratio" in this specification and are plotted as ordinates with the He proportions plotted as abscissas, and with the elapsed times as parameters in FIG. 10.

As is apparent from FIG. 9, the brightness maintenance ratio decreases with time. The decrease in brightness maintenance ratio decreases with increasing He proportion. In FIG. 10, the reduction in brightness maintenance ratio is not so large until the He proportion is increased to 50% as compared with that of the discharge-gas mixture having the zero He proportion, but the brightness maintenance ratio decreases sharply when the He proportion is selected to be 60% or more. In other words, if the He proportion exceeds 50%, the lifetime of the PDPs is sharply reduced, thereby to decrease its practical value.

As is apparent from the above experiments, the lifetime of the PDPs is sufficiently guaranteed by limiting the He proportion to 50%. These characteristics related to lifetime, that is, the rate of change in brightness maintenance ratio are secured by the discharge-gas mixtures containing He and Xe in the proportions in accordance with the present invention.

Figure 11:
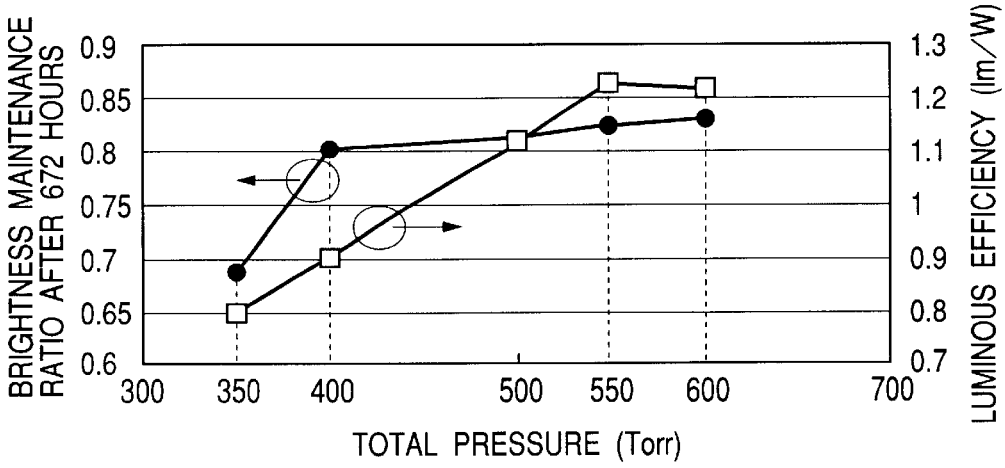
FIG. 11 is a graph showing results obtained by measurements of the brightness maintenance ratios and luminous efficiencies when a total pressure of a three-component discharge-gas mixture containing Ne, Xe and He is changed.

In the embodiments in accordance with the present invention, changes in luminous efficiency and lifetime are studied varying a total pressure of the discharge-gas mixture containing 62% of Ne, 8% of Xe and 30% of He. Lifetime was evaluated by using brightness maintenance ratios after 672 hours of operation. FIG. 11 shows the experimental results. The abscissas represent total pressures of the gas mixtures, and the ordinates represent the lifetime denoted by solid circles and the luminous efficiency denoted by open squares. As is apparent from FIG. 11, the luminous efficiency is improved by increasing the total pressure of the gas mixture from 350 Torr to 550 Torr without changing the gas-mixture composition. However, the luminous efficiency is no longer improved even if the total pressure is increased from 550 Torr to 600 Torr. Also, since the total pressure of 600 Torr is too high, a difference between the total pressure and the atmospheric pressure becomes so small that the panel of the PDP may be destroyed at low atmospheric-pressure places such as a plane or highland because the panel internal pressure becomes higher than the atmospheric pressure. Further, the luminous efficiency becomes low when the total pressure is selected to be 350 Torr or less, and the brightness maintenance ratio (lifetime) decreases sharply. If the total pressure is too low, a mean free path is increased which ions travel before they collide with other neutral atoms, and as a result the kinetic energy of the ions striking the protective film or the phosphor surface of the PDP is increased, and consequently, the brightness maintenance ratio (lifetime) is reduced. Therefore, for the discharge-gas mixtures containing He, the optimum total pressure is in a range of from 400 to 550 Torr.

By similar experiments using a discharge-gas mixture containing 66% of Ne, 4% of Xe and 30% of He and another discharge-gas mixture containing 58% of Ne, 14% of Xe and 30% of He, it was found again that the optimum total pressure is in a range of from 400 Torr to 550 Torr.

Next, discharge stability will be discussed. In the evaluations of the discharge-gas mixture composition, their total pressures and lifetime, there has been a problem in that discharge became unstable when the Xe proportion was increased. In particular, when only one line of cells arranged in the direction D2 in FIG. 1 is lit, a phenomenon of flickering appears pronouncedly on the display screen of the PDP. By studying this phenomenon thoroughly, it was found that a delay in a write-discharge is produced after a voltage of the voltage pulse profile 52 is applied to an A-electrode 29 during the write-discharge period 50 illustrated in (II) of FIG. 4A, and as a result, discharge is not sometimes produced even when the write-voltage pulse is applied to the A electrode 29.

It is thought that the reason for occurrence of the delay in the write-discharge is that reduction in number of priming particles (charged particles and excited neutral particles) floating in the discharge space is sped up by increasing the Xe proportion. More specifically, as is apparent from FIG. 1, in the case where only one line of cells arranged in the direction D2 in FIG. 1 is lit, the light-emitting cells are free from influences of discharge-facilitating priming particles in adjacent cells because the light-emitting cells are separated from each other by the ribs 31. This is particularly because, among Xe atoms excited in a metastable state, the amount of the excited Xe atoms which form excited $Xe_2$ molecules after three body collision with other Xe atoms, then emit light, and finally disappear is increased by increasing the Xe proportion.

The following three methods will be conceivable as countermeasures for eliminating the above-explained delay in discharge of the write-discharge:

(1) Increasing of the voltage V0 of the write-discharge, i.e., increasing the electric field strength in the discharge space;

(2) Increasing of the He concentration, i.e., speeding up formation of discharge by increasing the He proportion for the purpose of increasing mobility of positive ions in the discharge-gas mixture; and (3) Increasing of a width $\tau_a$ of voltage pulses to be applied to the A electrode widened, i.e., increasing the pulse width $\tau_a$ by a time corresponding to the discharge delay.

Figure 12:
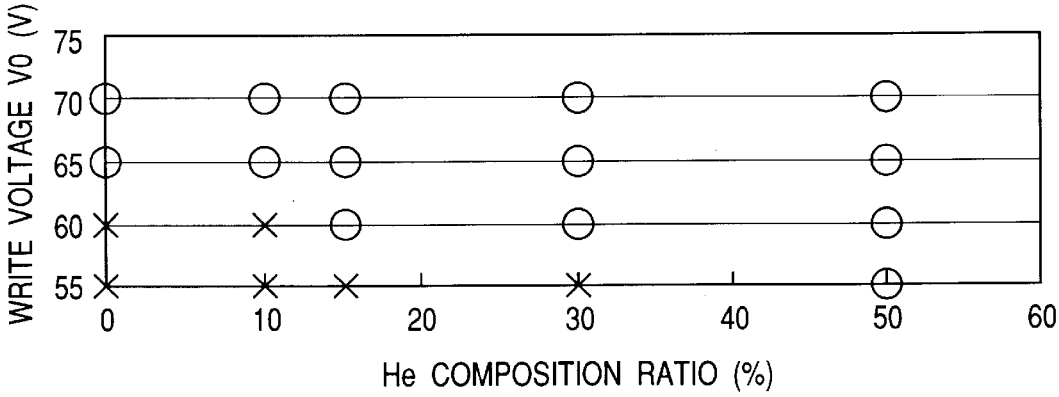
FIG. 12 is a graph showing results obtained by investigation of conditions for securing stable write-discharges when a write-voltage and the He proportion of a three-component discharge-gas mixture containing Ne, Xe and He are changed.

FIG. 12 shows results obtained by studying the state of write-discharge in a case where only one line of cells arranged in the direction D2 in FIG. 1 is lit, and voltages for write-discharge (write-voltage) and the He concentration are varied. In this case, the Xe proportion is 12%, and a total pressure is 500 Torr. In FIG. 12, open circles denote normal write-discharge conditions, and x denote abnormal write-discharge conditions. Here, the width $\tau_a$ of voltage pulses to be applied to the A electrodes was 2 $\mu$s. As shown in FIG. 4A, the length of the write-discharge period 50 is limited, and a specified number of write-discharges must be performed within the write-discharge period 50. If the brightness is required to be increased, the number of the sustaining discharge voltage pulses needs to be increased, and as a result the sustaining-discharge period must be lengthened by shortening the write-discharge period. When the write-discharge period is shortened, the pulse width $\tau_a$ needs to reduced. Further, when display resolution is required to be increased, the number of discharge cells must be increased, and as a result the write-discharge period needs to be increased. Consequently, the pulse width $\tau_a$ must be decreased, and specifically, it must be equal to or shorter than 2 $\mu$s.

It is found from FIG. 12 that the write-discharge condition becomes better as the He proportion and the write voltage are increased. However, as described above, the acceptable upper limit of the He proportion is 50% because lifetime decreases sharply if the He proportion exceeds 60%. On the other hand, if the write-voltage is increased, high-voltage drivers are necessary for applying voltage pulses to the A electrodes, resulting in higher cost. Therefore, it is necessary to reduce the write-voltage and reduce the cost by adding He of the proportion in such a range as not to adversely affect the lifetime of PDPs.

FIG. 12 shows the results obtained in the case of the Xe proportion of 12% by way of example, but the write-discharge condition becomes better as the He proportion and the write-voltage are increased, also in the cases of the Xe proportions of 2%, 6%, 8%, 14% and 20%. Therefore, for all of the above Xe proportions, it is necessary to reduce the voltage of write-discharge by adding He of the proportion in such a range not to adversely affect the lifetime of the PDP, and to select the width $\tau_a$ of voltage pulses to be applied to the A electrodes to be 2 $\mu$s or less.

More specifically, stable driving and a high-brightness display of the PDPs are secured by adding He of the proportion in a range of from 15% to 50% to a discharge-gas mixture containing Xe of the proportion in a range of from 2% to 20% and selecting the width of voltage pulses applied to the A electrodes to be 2 $\mu$s or less.

Figure 13:
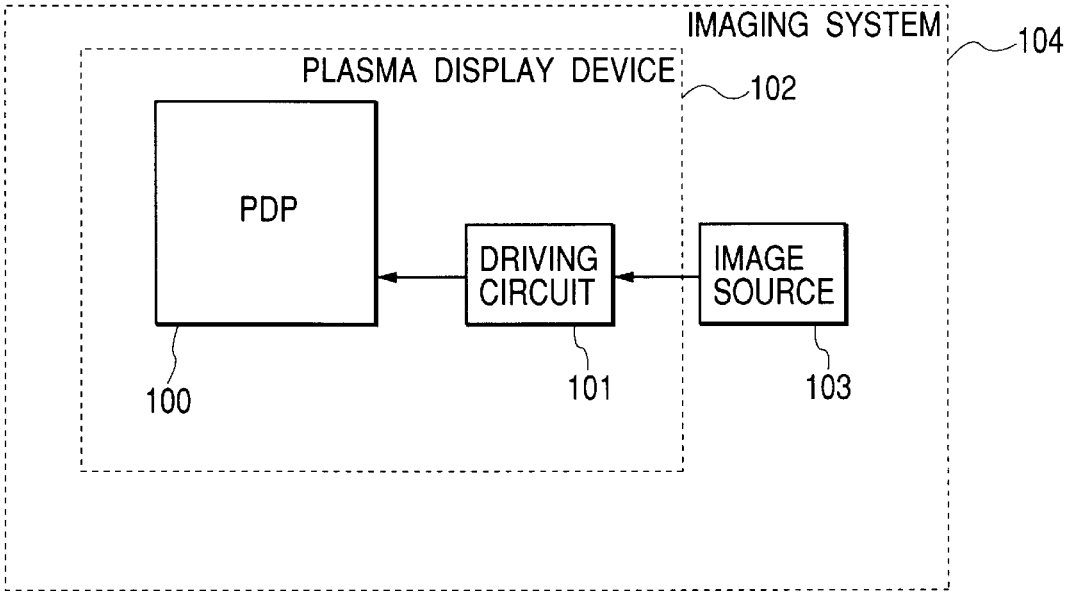
FIG. 13 is a block diagram showing an example of imaging system provided with the PDP of the present invention.

Next, an example of an imaging device according to the present invention will be described. FIG. 13 is a block diagram showing an example of an imaging system 104. An imaging device (a plasma display device) 102 comprises a PDP 100 and a driving circuit 101 for driving the PDP 100. The imaging system 104 comprises an image source 103 for sending image information to the imaging device 102. The imaging system itself can be a conventional one, and therefore, its detailed description is omitted.

The imaging device is assembled by connecting the driving circuit 101 to the PDP provided with a discharge-gas mixture containing 62% of Ne, 8% of Xe and 30% of He with a total pressure of the discharge-gas mixture set at 500 Torr. The image source 103 for sending image signals to the imaging device is connected to the imaging device to thereby construct the imaging system. Evaluation of images of the imaging system was conducted. The imaging system of the present example exhibits the characteristics of high luminous efficiency without instability in operation and guarantees long lifetime.

As described above in detail, the present invention provides a PDP capable of high luminous efficiency, guaranteeing long lifetime, and driving stably. Further, the present invention provides a PDP capable of driving at high brightness, high definition and low cost. The present invention provides a higher brightness than the conventional PDPs, because of the increased luminous efficiency. Further, the present invention makes it possible to shorten the write-discharge period by decreasing the width of voltage pulses applied to the A electrodes. By performing such operation of the write discharge, it is possible to increase the number of discharge cells. Therefore, the present invention is capable of providing a high definition PDP. Also, since the invention is capable of securing high luminous efficiency by utilizing a lower sustaining discharge voltage, the invention provides a PDP capable of being driven at a lower cost.

The present invention provides a PDP capable of having its luminous efficiency improved, securing long lifetime and being driven stably.

Employment of the plasma display device in accordance with the present invention provides an imaging system capable of operating stably at high brightness and guaranteeing long lifetime.

What is claimed is:

1. A plasma display panel comprising:

a pair of sustaining discharge electrodes;

an address electrode facing said pair of sustaining discharge electrodes;

a discharge space disposed between said pair of sustaining discharge electrodes and said address electrode, said discharge space being filled with a discharge-gas mixture containing at least Xe, Ne and He; and a circuit for applying a voltage pulse to said address electrode and thereby producing a write-discharge in said discharge space, wherein a Xe proportion of said discharge-gas mixture is in a range of from 2% to 20%, a He proportion of said discharge-gas mixture is in a range of from 15% to 50%, said He proportion being greater than said Xe proportion, a total pressure of said discharge-gas mixture is in a range of from 400 Torr to 550 Torr, and a width of said voltage pulse is 2 $\mu$s or less.

2. A plasma display panel according to claim 1, wherein said Xe proportion of said discharge-gas mixture is in a range of from 2% to 14%.

3. A plasma display panel according to claim 1, wherein said Xe proportion of said discharge-gas mixture is in a range of from 6% to 14%.

4. A plasma display panel according to claim 1, wherein said Xe proportion of said discharge-gas mixture is in a range of from 6% to 12%.

5. An imaging device comprising said plasma display panel according to claim 1, and a driving circuit including at least a control circuit, for driving said plasma display panel.

6. An imaging device comprising said plasma display panel according to claim 2, and a driving circuit including at least a control circuit, for driving said plasma display panel.

7. An imaging device comprising said plasma display panel according to claim 3, and a driving circuit including at least a control circuit, for driving said plasma display panel.

8. An imaging device comprising said plasma display panel according to claim 4, and a driving circuit including at least a control circuit, for driving said plasma display panel.

* * * * *